US005901600A

United States Patent [19]

Decker

[11] Patent Number: 5,901,600

[45] Date of Patent: May 11, 1999

[54] ROD BENDING DEVICE

[76] Inventor: Ronald R. Decker, 8820 Morning Ave., NW., Clinton, Ohio 44216

[21] Appl. No.: 08/907,232

[22] Filed: Aug. 6, 1997

[51] Int. Cl.[6] ..... B21D 9/05

[52] U.S. Cl. ..... 72/388; 72/458

[58] Field of Search ..... 72/387, 388, 458, 72/459

[56] References Cited

U.S. PATENT DOCUMENTS

| | | | |
|---|---|---|---|
| 699,858 | 5/1902 | Vollmer . | |
| 1,319,798 | 10/1919 | Satterlee | 72/388 |
| 1,510,162 | 9/1924 | Robinson . | |
| 1,987,021 | 1/1935 | Mason et al. . | |
| 2,502,713 | 4/1950 | Fagge | 72/388 |
| 2,568,691 | 9/1951 | Wildman . | |
| 2,675,723 | 4/1954 | Stein . | |
| 2,956,608 | 10/1960 | Vinkemulder | 72/388 |
| 3,538,737 | 11/1970 | Del Monica . | |
| 3,729,975 | 5/1973 | Del Monica | 72/388 |
| 3,901,064 | 8/1975 | Jacobson | 72/388 |

FOREIGN PATENT DOCUMENTS

| | | | |
|---|---|---|---|
| 124386 | 1/1928 | Switzerland | 72/386 |
| 600171 | 4/1948 | United Kingdom | 72/388 |

*Primary Examiner*—David Jones
*Attorney, Agent, or Firm*—Sand & Sebolt

[57] ABSTRACT

A rod bending device includes an L-shaped bracket formed by a mounting plate adjoined to a support plate at a substantially 90° angle. The bracket is mounted to an outwardly extending corner wall whereby an outer surface of the support plate aligns with one of the intersecting corner walls. A bending assembly is mounted to the support plate and includes a pivot support block and corner block which extend outwardly from the support plate and which are spaced from and parallel to one another forming a rod retaining cavity therebetween. The corner block having a corner edge which forms the fulcrum about which the rod is bent. An end block extends between the corner block and the pivot support block to enclose the rod retaining cavity. A gap is formed between an upper portion of the pivot support block and the support plate for receiving a pivot arm. The pivot arm is pivotally secured within the gap. An outer free end of the pivot arm is formed with a rod receiving channel which engages the rod to be bent and retains the rod substantially in line with the pivot arm. The pivot arm has a pivot point which is positioned on a side of the rod receiving cavity opposite that of the fulcrum of the corner block.

24 Claims, 6 Drawing Sheets

ROD BENDING DEVICE

BACKGROUND OF THE INVENTION

1. Technical Field

Generally, the invention relates to a rod bending device. Particularly, the invention relates to a device having a bracket which supports the rod on a vertical wall while a pivot arm engages and bends the rod. More particularly, the invention relates to a rod bending device which can be mounted on any outwardly extending corner wall for retaining the rod within a bending assembly while the pivot arm having a U-shaped channel engages the rod and bends the rod about a corner block.

2. Background Information

Rods bent in L-shaped or U-shaped configurations are used in numerous applications. Particularly, automobile muffler systems require curved rods which extend into rubber bushings or housings of the automobile chassis and curve around a bottom of the muffler system to vertically support the muffler system to the chassis. These bent rods are available as "off-the-shelf" parts from the automobile manufacturer or from after market suppliers, but it is much less expensive for muffler repair shops to purchase straight rods and bend and cut the straight rods to fit the particular automobile and muffler system. By bending their own rods, the muffler repair shops can create muffler supports for virtually any type of automobile having the rubber bushing and curved support rod configuration.

Various devices have been invented which are used to bend a rod or pipe. For example, U.S. Pat. No. 669,858 discloses a machine for bending iron—flat and angle—having a guide block and former between which the iron is placed. A cam mechanism advances the former into and out of the operative position when the former is placed in the operative position, the iron is sandwiched between the former and the guide block and an operating arm is pivoted horizontally to bend the iron at the desired angle. A supplemental operating arm pivots vertically over the iron to prevent the iron from buckling and to help produce an even bend.

U.S. Pat. No. 1,510,162 discloses a pipe bending machine having a pair of rollers between which the pipe is inserted. A bending block is formed with a channel into which the pipe is placed and secured by a u-bolt. A handle is attached to a bending block and is used to pivot the bending block around the top roller. As the handle and bending block are pivoted, the pipe bends around the top roller into its desired configuration.

U.S. Pat. No. 1,987,021 discloses a bending machine having a pair of formers around which a pipe is bent. A handle pivots to bend the rod at a 90° angle. The formers are separated and the handle is further pivoted to create a U-shaped bend in the rod.

U.S. Pat. No. 2,675,723 discloses a pivoted rod bending hand tool having first and second pivot arms. A guide formed with a channel is rigidly mounted to the first pivot arm and engages the rod. The second pivot arm pivots relative to the guide and first pivot arm and includes a bearing sleeve which rolls along the rod as the rod is bent by the pivotal movement of the second pivot arm.

Although these prior art rod bending devices are adequate for the purpose for which they are intended, several of these rod bending devices require a horizontal work surface such as a workbench or table upon which the device is mounted to keep the device stationary while bending rods. In a small place such as a muffler repair shop, it is undesirable to waste the limited amount of available horizontal work space on a rod bending device. Also, because the rods are often bent before they are cut to the specific size, there may not be enough room in the muffler repair shop for the rod to be clamped in the rod bending devices and extend horizontally outwardly therefrom possibly hitting and damaging cars or blocking aisle ways.

Other of the prior art rod bending devices require that the rod be clamped or otherwise mechanically secured within the device before the rod can be bent. Because of the large number of rods which must be bent in a single day, it would be inefficient to mechanically clamp each rod bent by the rod bending device. The muffler shops require a device in which the rod can be placed and quickly bent by the activation of an arm or lever.

Therefore, the need exists for a rod bending device which mounts vertically to a wall and in which the rod may be quickly inserted and bent by the activation of a pivot arm.

SUMMARY OF THE INVENTION

Objectives of the invention include providing an improved rod bending device which mounts vertically to an outwardly extending corner wall.

A further objective is to provide a rod bending device into which the rod is quickly and easily inserted for subsequent bending by the device.

Another objective is to provide a rod bending device in which a pivot arm engages the rod and pivots about a pivot point to bend the rod.

A still further objective is to provide a rod bending device which is of simple construction, which achieves the stated objectives in a simple, effective and inexpensive manner, which solves problems and satisfies needs existing in the art.

These objectives and advantages are obtained by the improved rod bending device of the present invention, the general nature of which may be stated as including a device for bending a rod, including: a bracket adapted to be secured to a wall for vertically supporting the device on the wall; a bending assembly rigidly secured to the bracket and formed with a rod receiving cavity for receiving the rod therein and a fulcrum about which the rod is bent, said fulcrum positioned adjacent the rod receiving cavity; and a pivot arm pivotally attached to the bending assembly for bending the rod, said pivot arm pivoting about a pivot point which extends parallel to the fulcrum of the bending assembly on a side of the rod receiving cavity opposite that of said fulcrum.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
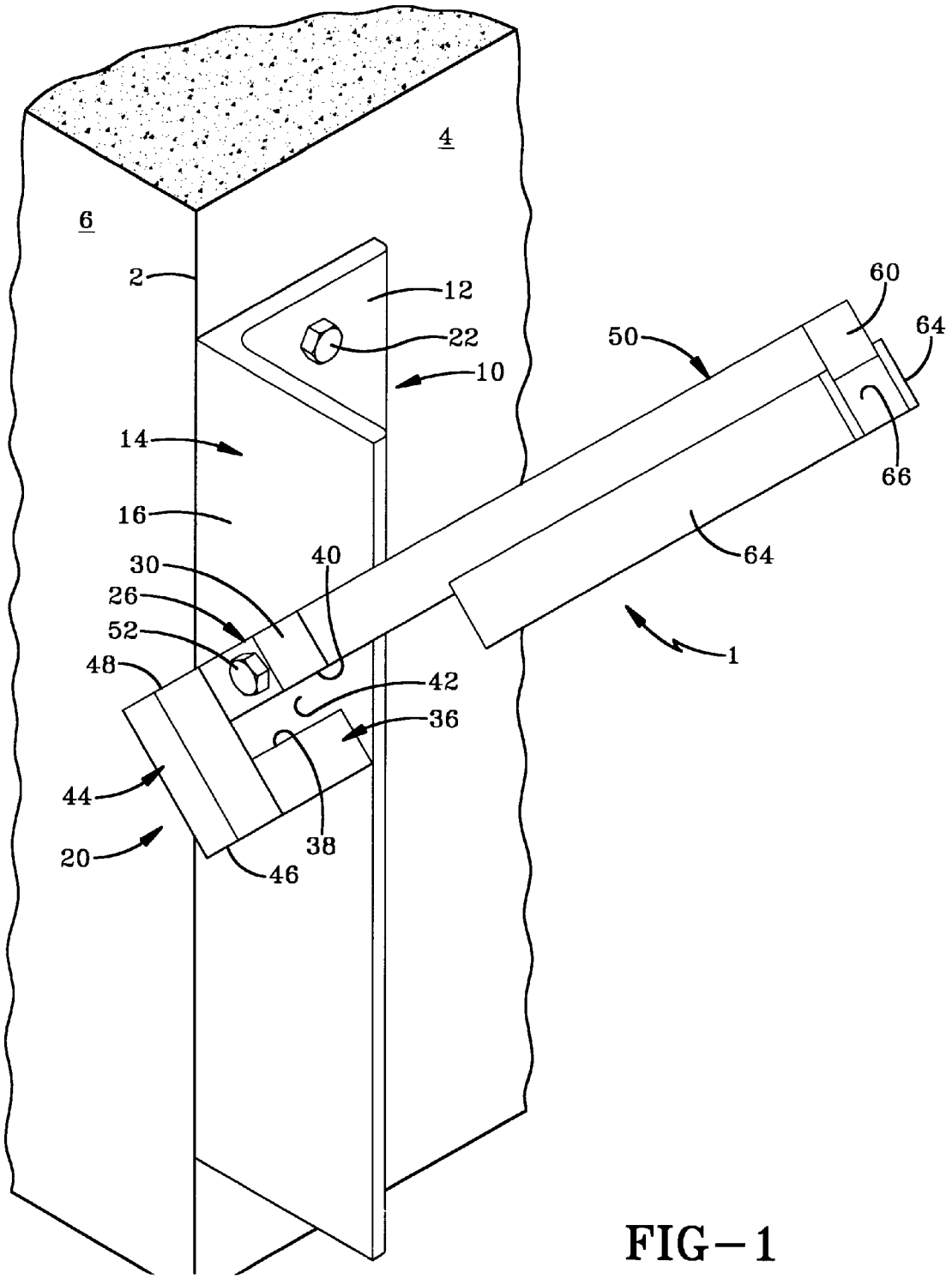
FIG. 1 is a perspective view of the rod bending device of the present invention shown mounted on an outwardly extending corner wall.
Figure 2:
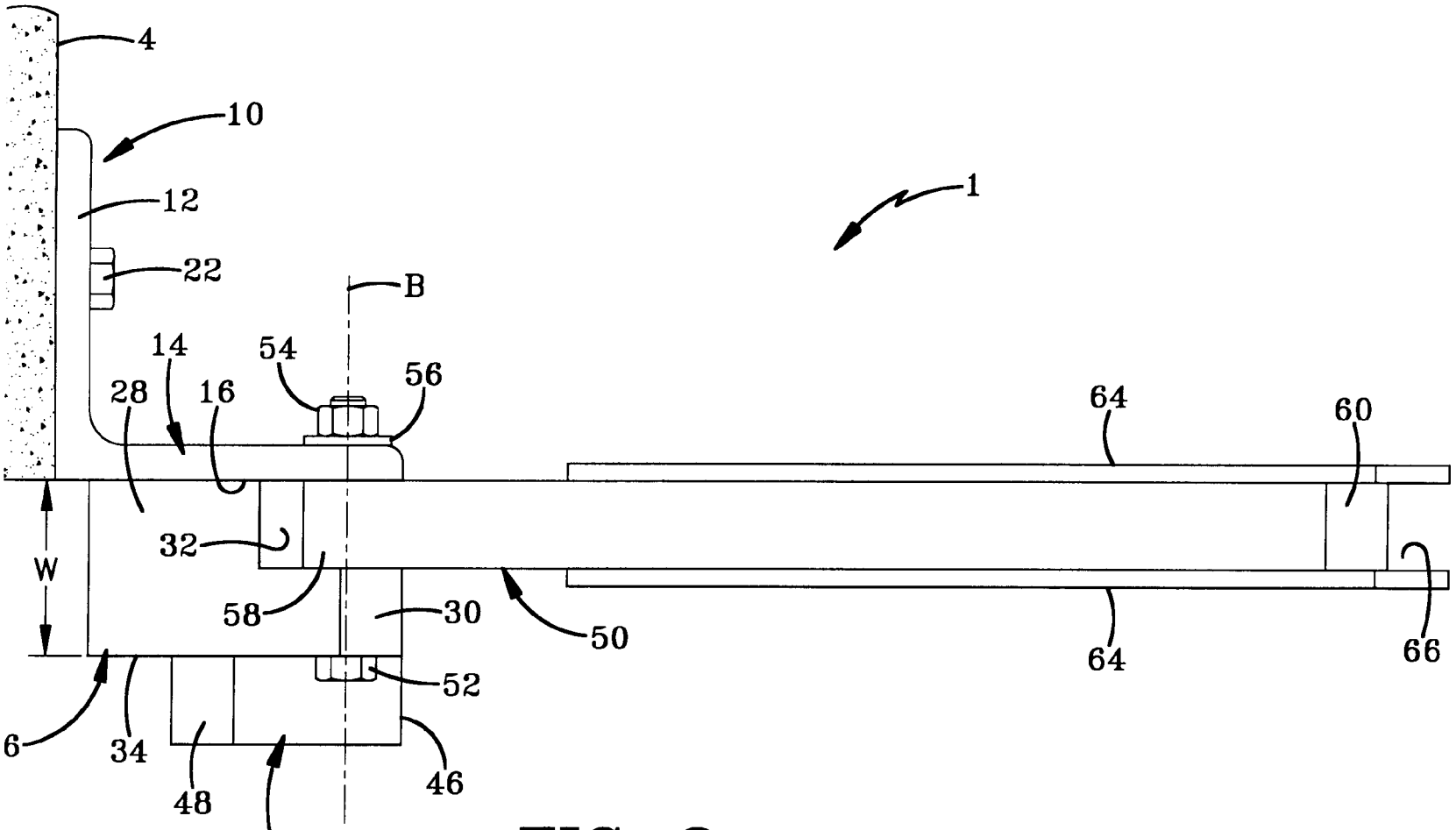
FIG. 2 is a top plan view of the device of FIG. 1.

The rod bending device of the present invention is shown in FIG. 1 and is indicated generally at 1. Device 1 mounts adjacent to an outwardly extending corner 2 formed by a pair of adjoining first and second walls 4 and 6, respectively. Device 1 includes a generally L-shaped bracket 10 which is formed by a flat mounting plate 12 connected to a flat support plate 14 at an approximately 90° angle. Support plate 14 has an outer surface 16 which supports a bending assembly 20. Mounting plate 12 is mounted on first wall 4 by a plurality of bolts 22. Mounting plate 12 is positioned on first wall 4 whereby outer surface 16 of support plate 14 extends substantially in line with second wall 6 and extends outwardly therefrom (FIGS. 1 and 2).

Bending assembly 20 includes a pivot support block 26 (FIG. 2) rigidly secured to outer surface 16 of support plate 14. Pivot support block 26 has a lower base portion 28 which attaches to support plate 14 and an upper portion 30 which extends outwardly from base portion 28. Upper portion 30 extends substantially parallel to support plate 14 and is spaced from support plate 14 by a gap 32. Upper portion 30 of pivot support block 26 extends outwardly from base portion 28 at an angle A (FIG. 3) which in the preferred embodiment is between 40° and 50° measured from a vertical axis, and more particularly, is approximately 45°. Pivot support block 26 has a width W (FIG. 2) measured from outer surface 16 of support plate 14 to an outer surface 34 of support block 26 of approximately 1½". Upper portion 30 of support block 26 has a width measured from outer surface 34 to an inner surface 35 of upper portion 30 of approximately ⅞" while gap 32 has a width measured between support 14 and upper portion 30 of approximately ⅝".

A corner block 36 (FIGS. 1, 3 and 4) extends outwardly from support plate 14. Corner block 36 is spaced from and parallel to pivot support block 26 whereby an inner flat surface 38 of corner block 36 faces a bottom flat surface 40 of pivot support block 26 forming a straight rod receiving cavity 42 therebetween. Corner block 36 is an elongated generally rectangular-shaped block having a square cross-sectional shape (FIG. 3) which measures approximately ¾" by ¾". Block 36 is positioned on support plate 14 at an angle similar to angle A (FIG. 3), which in the preferred embodiment is approximately 45°. Corner block 36 is spaced slightly below gap 32 and extends outwardly from support plate 14, a distance substantially equal to width W of pivot support block 26, or approximately 1½". In the preferred embodiment cavity 42 is formed between pivot support 26 and corner block 36 with a width of approximately ⅜" and extends substantially parallel to upper portion 30 of pivot support block 26. Corner block 36 has a corner edge 43 which extends adjacent rod receiving cavity 42 to form a fulcrum over which a rod 68 is bent. Edge or fulcrum 43 extends outwardly from support plate 14 substantially perpendicular to support plate 14.

An end block 44 (FIGS. 1 and 2) extends between outer surface 34 of pivot support block 26 and the outer end of corner block 36 to enclose cavity 42. End block 44 has a length substantially equal to the sum of the thickness of corner block 36 (⅝") plus the width of cavity 42 (⅜") plus the depth of pivot support block 26 (¾"), or approximately 1¾". End block 44 has a substantially square cross-section similar to the cross-section of corner block 36 and includes a first end 46 which with corner block 36 free of any overlapping edges at the junction of end block 44 and corner block 36. Similarly, end block 44 has a second end 48 which aligns with an outer top surface 49 of pivot support block 26 free of any overlapping edges at the junction of the two blocks.

In accordance with one of the main features of the invention, a pivot arm 50 is pivotally mounted within gap 32 by a bolt 52, a nut 54 and a washer 56. A hole (not shown) is formed through upper portion 30 of pivot support block 26 which extends from outer surface 34 through upper portion 30 to communicate with gap 32. Another hole (not shown) is formed in support plate 14 which aligns with the hole of pivot support block 26. Pivot arm 50 is a square cross-sectional elongated bar having an inner pivot end 58 and an outer free end 60. Pivot arm 50 is formed with a circular hole 62 adjacent pivot end 58 thereof. Pivot end 58 extends within gap 32 whereby hole 62 aligns with the holes of pivot support block 26 and support flange 14 for receiving bolt 52 therethrough. Bolt 52 secures pivot arm 50 in place whereby pivot arm 50 is freely pivotal about a pivot point or axis B (FIG. 2). Axis or pivot point B extends perpendicular to support plate 14 substantially parallel to fulcrum 43 of corner block 36, and is positioned on an opposite side of rod receiving cavity 42 than fulcrum 43. Pivot arm 50 is attached to pivot support block 26 whereby pivot end 50 is spaced from lower base portion 28 of support block 26.

In accordance with another of the features of the invention, a pair of elongated plates 64 extend outwardly from each side of pivot arm 50 to form a rod receiving channel 66 therebetween. Plates 64 extend in a substantial downward direction when pivot arm 50 aligns with upper portion 30 of pivot support block 26 as shown in FIG. 1. Channel 66 retains rod 68 substantially in line with pivot arm 50 when rod 68 is being bent by device 1, and prevents lateral movement thereof. Although device 1 may be used to bend a rod 68 formed of various materials, rod 68 will typically be formed of iron.

Figure 3:
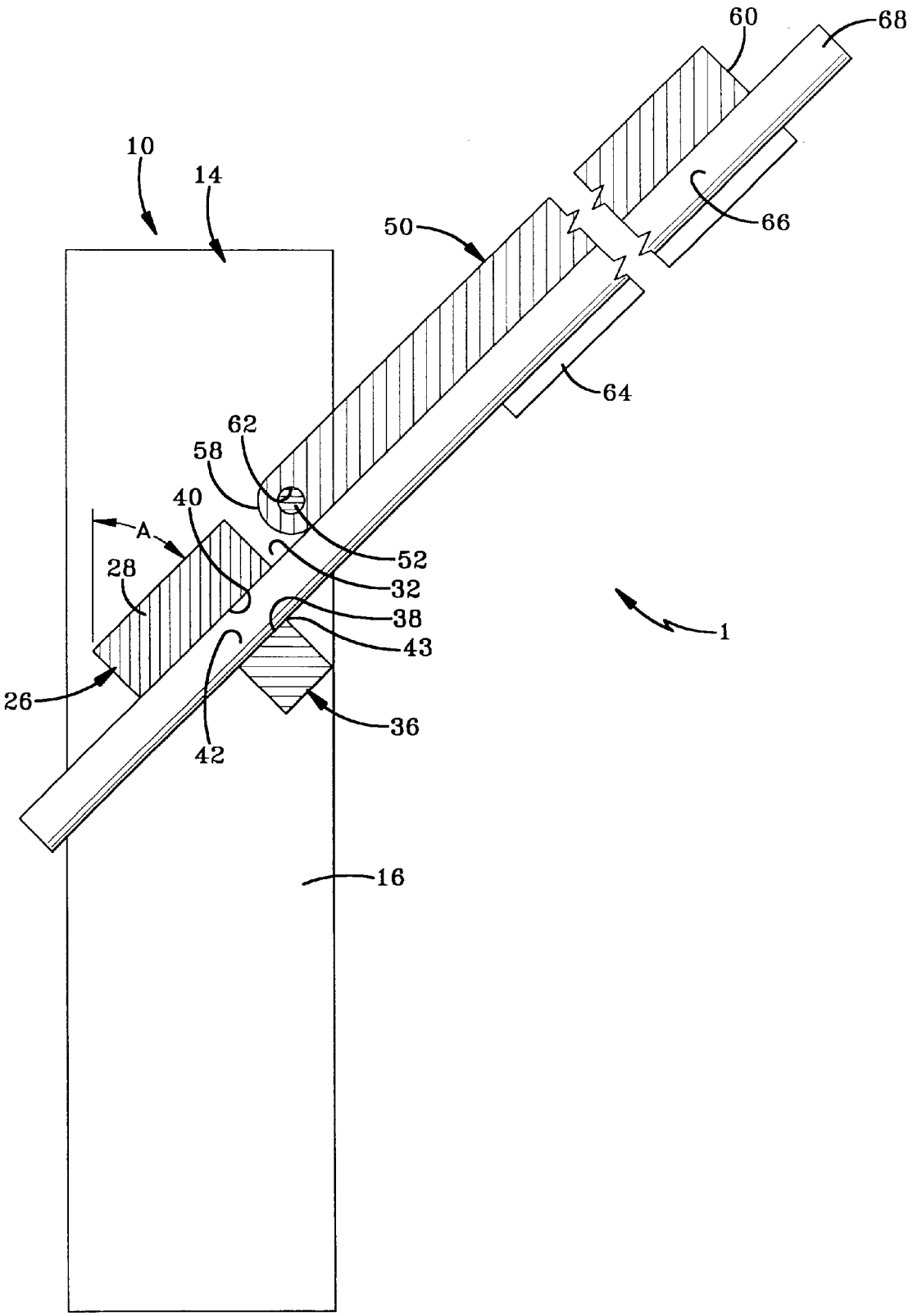
FIG. 3 is a side sectional view of the device of FIG. 2 shown holding a rod prior to bending of the rod.
Figure 4:
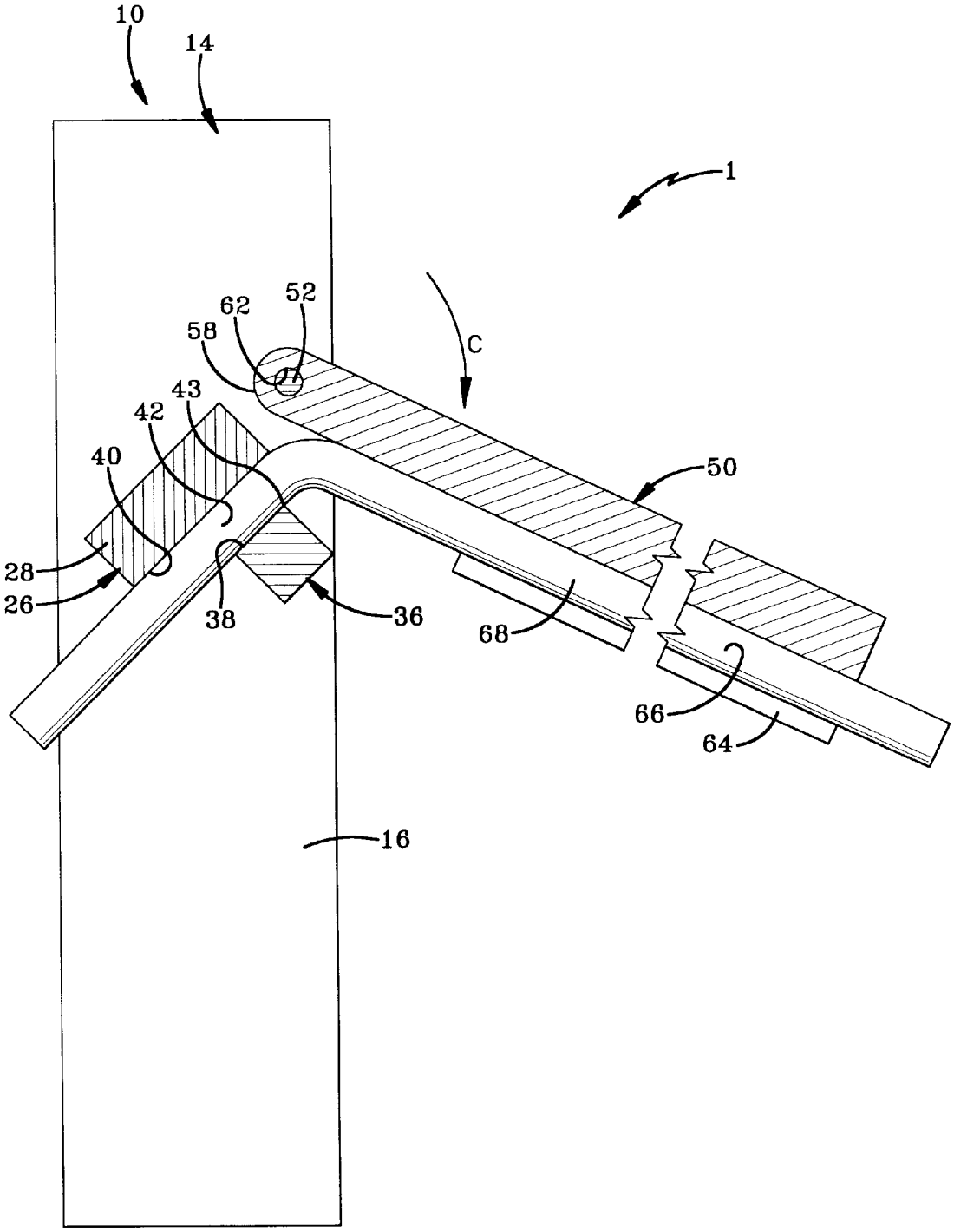
FIG. 4 is a side sectional view similar to FIG. 3 showing the rod being bent by the rod bending device of the present invention.

In use, rod 68 is inserted within rod retaining cavity 42 at a general 45° angle (FIG. 3). Pivot arm 50 is positioned adjacent rod 68 whereby rod 68 is received within rod receiving channel 66. A downward pressure is applied to pivot arm 50 in the direction of arrow C (FIG. 4) causing rod 68 to bend about fulcrum 43 of corner block 36. The lower portion of rod 68 will apply an upward pressure against pivot support block 26 and a downward pressure against corner block 36 when pivot arm 50 bends the upper portion of rod 68. Plates 64 retain rod 68 within rod receiving channel 66 substantially in line with arm 50. When rod 68 has been bent to the desired angle, the pressure on pivot arm 50 is released and pivot arm 50 is pivoted in a direction opposite to that of arrow C allowing rod 68 to be removed from rod retaining cavity 42.

Figure 5:
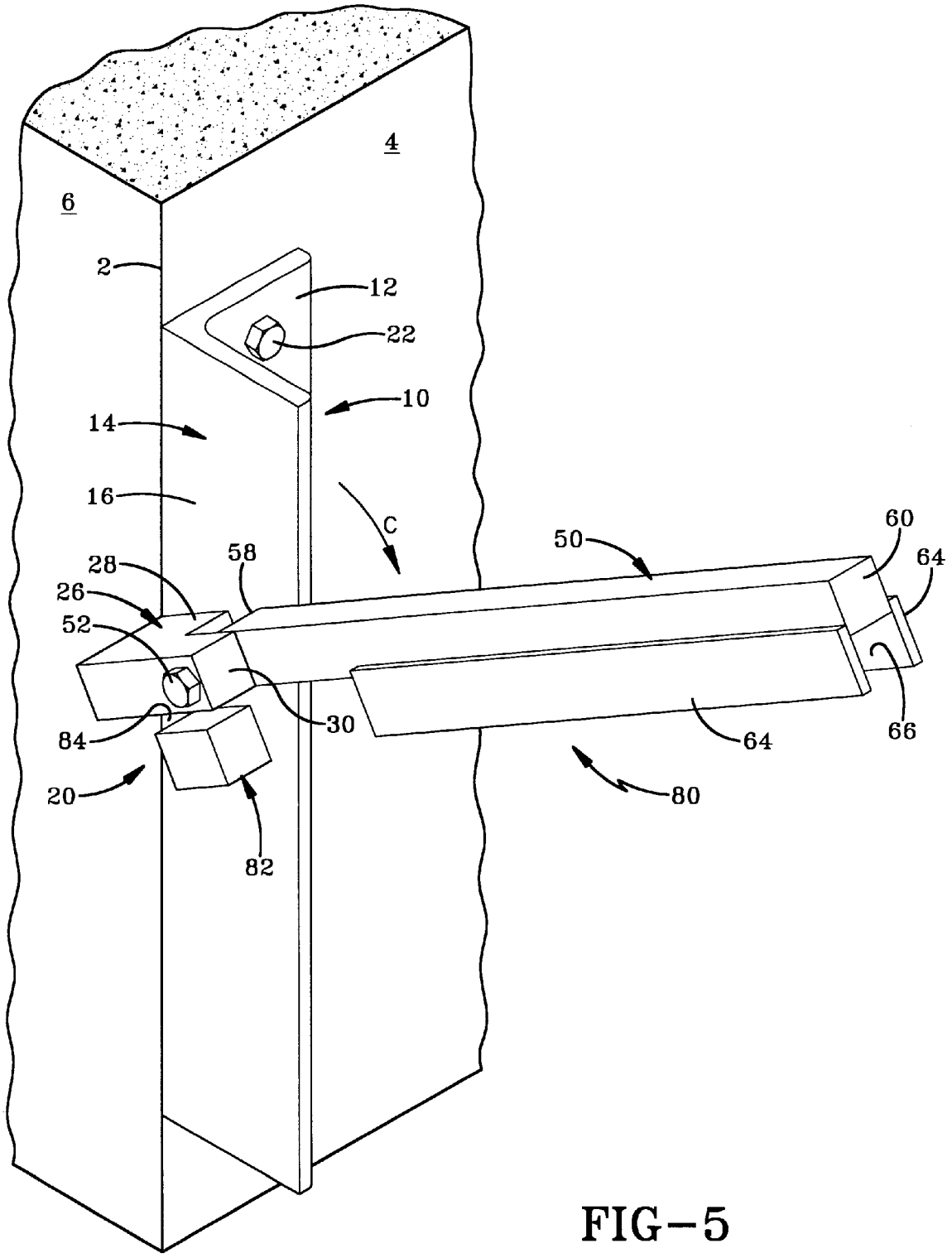
FIG. 5 is a perspective view of a second embodiment of the rod bending device of the present invention.
Figure 6:
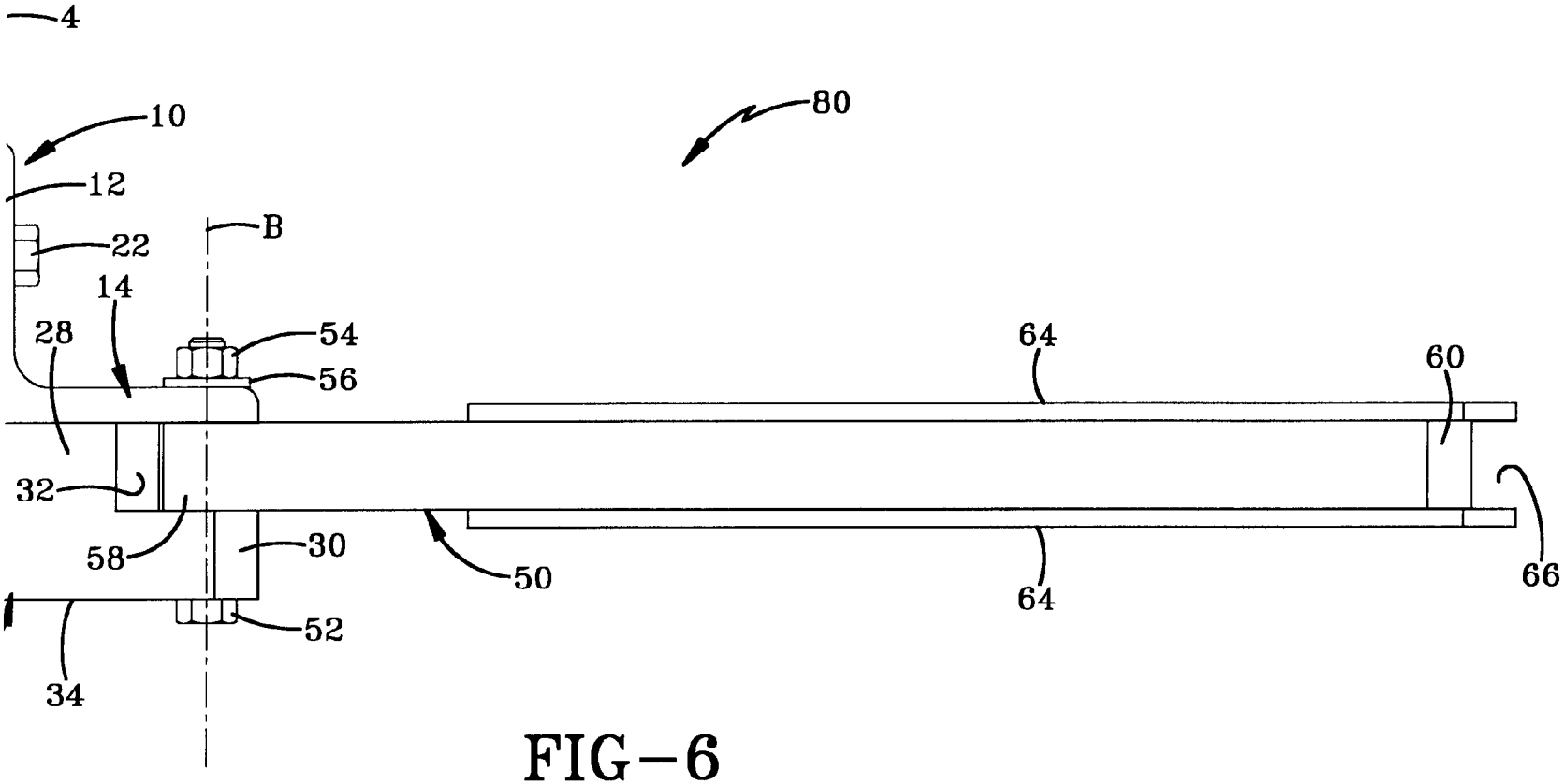
FIG. 6 is a top plan view of the device of FIG. 5.

A second embodiment of the rod bending device of the present invention is shown in FIGS. 5 and 6 and is indicated generally at 80. Device 80 is substantially similar to device 1 with the exception of corner block 36 and end block 44. Device 80 includes a corner block 82 which is substantially cube shaped and has a length substantially equal to the width of gap 32 formed between upper portion 30 of pivot support block 26 and support plate 14, or approximately ⅝". Device 80 is free of end block 44 forming an open rod retaining cavity 84.

Further, pivot support block 26 and corner block 82 of device 80 are mounted on support plate 14 whereby upper portion 30 of pivot support block 26 extends at an angle which is between 55° and 65° measured from a vertical axis and which preferably is approximately 60° measured from a vertical axis. Device 80 operates in a similar manner to device 1 with rod 68 inserted within rod retaining cavity 84 between corner block 82 and pivot support block 26. Pivot arm 50 of device 80 abuts rod 68 with rod receiving channel 66 engaging rod 68. Pivot arm 50 is pivoted in the direction of arrow C (FIG. 5) bending rod 68 about corner block 82. Rod 68 is removed from device 80 by pivoting pivot arm 50 in a direction opposite to that of arrow C and merely sliding rod 68 out open rod retaining cavity 84.

Although pivot arm 50 is shown in FIGS. 1–6 slightly shorter than rod 68, pivot arm 50 may be any length sufficient to bend rod 68. Pivot arm 50 is preferably 4'–5' in length to allow a sufficient amount of torque to be applied to outer free end 60 of pivot arm 50 to bend rod 68. Additionally, bracket 10, bending assembly 20 and pivot arm 50 are preferably integrally formed.

Accordingly, rod bending device 1 and 80 are easily mounted adjacent corner 2 allowing rod 68 to extend along second wall 6 while being bent by the devices. Rod 68 is held within rod retaining cavities 42 and 84 between pivot support block 26 and the corner blocks allowing a downward torque to be applied to pivot arm 50, thus bending rod 68 about corner blocks 36 and 82. Rod receiving channel 66 retains the rod in alignment with pivot arm 50 and prevents lateral slipping of rod 68 while rod 68 is being bent by devices 1 and 80. Pivot point B about which pivot arm 50 pivots, extends substantially parallel to fulcrum 43 and is positioned on an opposite side of rod retaining cavity 42.

Having now described the features, discoveries and principles of the invention, the manner in which the improved rod bending device is constructed and used, the characteristics of the construction, and the advantageous, new and useful results obtained; the new and useful structures, devices, elements, arrangements, parts and combinations, are set forth in the appended claims.

I claim:

1. A device for bending a rod, including:

a bracket adapted to be secured to a wall for vertically supporting the device on the wall;

a bending assembly rigidly secured to the bracket and formed with a rod receiving cavity for receiving the rod therein and a fulcrum about which the rod is bent, said fulcrum positioned adjacent the rod receiving cavity; and a pivot arm pivotally attached to the bending assembly for bending the rod, said pivot arm pivoting about a pivot axis extending parallel to the fulcrum of the bending assembly on a side of the rod receiving cavity opposite that of said fulcrum.

2. The device defined in claim 1 in which the bracket includes a mounting plate connected to a support plate.

3. The device defined in claim 2 in which the mounting plate extends at a substantially 90 degree angle to the support plate.

4. The device defined in claim 3 in which the mounting plate is adapted to be secured to the wall and the bending assembly is rigidly secured to the support plate.

5. The device defined in claim 1 in which the bending assembly includes a corner block which extends outwardly from the bracket, said corner block having a first end which is attached to the bracket and a second end opposite the first end.

6. The device defined in claim 5 in which the corner block includes an edge which extends substantially parallel to the bracket to form the fulcrum about which the rod is bent.

7. The device defined in claim 6 in which the bending assembly includes a pivot support block which extends outwardly from the bracket, said pivot support block having an outer surface.

8. The device defined in claim 7 in which the pivot support block is spaced from the corner block to form the rod receiving cavity therebetween.

9. A device for bending a rod, including:

a bracket adapted to be secured to a wall for vertically supporting the device on the wall;

a bending assembly rigidly secured to the bracket and formed with a rod receiving cavity for receiving the rod therein and a fulcrum about which the rod is bent, said fulcrum positioned adjacent the rod receiving cavity;

a pivot arm pivotally attached to the bending assembly for bending the rod, said pivot arm pivoting about a pivot point which extends parallel to the fulcrum of the bending assembly on a side of the rod receiving cavity opposite that of said fulcrum;

the bending assembly including a corner block which extends outwardly from the bracket, said corner block having a first end which is attached to the bracket and a second end opposite the first end;

the corner block including an edge which extends substantially parallel to the bracket to form the fulcrum about which the rod is bent;

the bending assembly including a pivot support block which extends outwardly from the bracket, said pivot support block having an outer surface;

the pivot support block being spaced from the corner block to form the rod receiving cavity therebetween; and the pivot support block being formed with an upper portion which is spaced from the bracket to form a gap therebetween, said upper portion extending outwardly parallel to the bracket.

10. The device defined in claim 9 in which the rod receiving cavity is formed between the pivot support block and the corner block substantially parallel to the upper portion of the support block.

11. The device defined in claim 10 in which the pivot arm is pivotally secured within the gap formed between the upper portion of the pivot support block and the bracket.

12. The device defined in claim 11 in which the pivot arm is formed with a channel for receiving the rod as said pivot arm bends the rod.

13. The device defined in claim 12 further including a pair of plates which extend outwardly from the pivot arm to form the channel.

14. The device defined in claim 13 in which an end block extends between the outer surface of the pivot support block and the second end of the corner block to enclose the rod receiving cavity.

15. The device defined in claim 14 in which the upper portion of the pivot support block extends outwardly parallel to the bracket at an angle of between 40 and 50 degrees measured from a vertical axis.

16. The device defined in claim 15 in which the upper portion of the pivot support block extends outwardly parallel to the bracket at an angle of approximately 45 degrees measured from a vertical axis.

17. The device defined in claim 13 in which the upper portion of the pivot support block extends outwardly parallel to the bracket at an angle of between 55 and 65 degrees measured from a vertical axis.

18. The device defined in claim 17 in which the upper portion of the pivot support block extends outwardly parallel to the bracket at an angle of approximately 60 degrees measured from a vertical axis.

19. A device for bending a rod, including:

a bracket adapted to be secured to a wall for vertically supporting the device on the wall;

a bending assembly rigidly secured to the bracket and formed with a rod receiving cavity for receiving the rod therein, a fulcrum about which the rod is bent, and a pivot support block;

said pivot support block being formed with an upper portion which is spaced from the bracket to form a gap therebetween, said upper portion extending outwardly parallel to the bracket;

said fulcrum positioned adjacent the rod receiving cavity; and a pivot arm pivotally attached to the bending assembly for bending the rod.

20. The device defined in claim 19 in which the bending assembly includes a corner block which extends outwardly from the bracket, said corner block having a first end which is attached to the bracket and a second end opposite the first end.

21. The device defined in claim 20 in which the corner block includes an edge which extends substantially parallel to the bracket to form the fulcrum about which the rod is bent.

22. The device defined in claim 21 in which the pivot support block is spaced from the corner block to form the rod receiving cavity therebetween.

23. The device defined in claim 22 in which the pivot arm is pivotally secured within the gap formed between the upper portion of the pivot support block and the bracket.

24. The device defined in claim 23 in which the pivot arm is formed with a channel for receiving the rod as said pivot arm bends the rod.

* * * * *